US007934625B2

(12) United States Patent
Gabler

(10) Patent No.: US 7,934,625 B2
(45) Date of Patent: May 3, 2011

(54) PARTICLE DISPENSER FOR CONDIMENTS AND GRANULAR MATERIALS

(76) Inventor: Robert J Gabler, LaGrangeville, NY (US)

( * ) Notice: Subject to any disclaimer, the term of this patent is extended or adjusted under 35 U.S.C. 154(b) by 0 days.

(21) Appl. No.: 12/720,839

(22) Filed: Mar. 10, 2010

(65) Prior Publication Data

US 2010/0155421 A1 Jun. 24, 2010

Related U.S. Application Data

(63) Continuation-in-part of application No. 11/654,889, filed on Jan. 19, 2007.

(51) Int. Cl.
*A47G 19/00* (2006.01)

(52) U.S. Cl. ..... 222/142.1; 222/457.5; 222/480; 222/142.2

(58) Field of Classification Search ..... 222/142.1, 222/457.5, 480, 142.2, 564, 547, 500–503, 222/459, 196.5
See application file for complete search history.

(56) References Cited

U.S. PATENT DOCUMENTS

| | | | | | |
|---|---|---|---|---|---|
| 270,189 | A | * | 1/1883 | Golding | 222/173 |
| 968,890 | A | | 8/1910 | Sprinkle | |
| 1,765,152 | A | | 6/1930 | Hart | |
| 1,891,824 | A | * | 12/1932 | Madigan | 222/196.2 |
| 2,459,133 | A | | 1/1949 | Nyberg | |
| 2,644,616 | A | * | 7/1953 | Gordon | 222/183 |
| 2,773,628 | A | | 12/1956 | Gabler | |
| 2,821,331 | A | | 1/1958 | Kuhn | |
| 3,204,826 | A | * | 9/1965 | Fidel | 222/142.1 |
| 3,311,275 | A | * | 3/1967 | Gibson | 222/567 |
| 4,804,113 | A | | 2/1989 | Ciaccio | |
| 4,881,666 | A | * | 11/1989 | Tullman et al. | 222/386.5 |
| 4,936,498 | A | * | 6/1990 | Pirila | 222/420 |
| 5,083,679 | A | | 1/1992 | Plough | |
| 5,083,680 | A | * | 1/1992 | Plough | 222/142.1 |
| 5,630,523 | A | * | 5/1997 | Wright | 220/23.83 |
| 6,158,623 | A | | 12/2000 | Benavides | |
| 7,059,496 | B2 | | 6/2006 | Stern | |
| 7,066,418 | B2 | | 6/2006 | Ng | |
| 2006/0060686 | A1 | | 3/2006 | Cheng | |
| 2009/0218368 | A1 | | 9/2009 | Watson | |

FOREIGN PATENT DOCUMENTS

GB 190427692 12/1901

* cited by examiner

*Primary Examiner* — Kenneth Bomberg
*Assistant Examiner* — Robert K Nichols, II

(57) ABSTRACT

A combination particle dispenser for condiments or granular substances having a container partitioned to provide separate chambers with a closure means on each end. Each closure means has an inwardly extending, funnel-like centrally disposed outlet. Particle-blocking means which is secured in each chamber has a surface facing, proximate to and in alignment with the outlet with a gap between that surface and the outlet. Particles not emitted from the outlet descend to rest in the chamber on the closure surface after diversion by the blocking means.

4 Claims, 3 Drawing Sheets

PARTICLE DISPENSER FOR CONDIMENTS AND GRANULAR MATERIALS

CROSS-REFERENCE TO RELATED APPLICATIONS

This application is a continuation-in-part of U.S. patent application Ser. No. 11/654,889 entitled "Combination Condiment Dispenser" filed 19 Jan. 2007, the priority of which is claimed, is incorporated herein by reference in its entirety.

U.S. Pat. Ser. No. 2,773,628 entitled "Combination Condiment Dispenser" was granted to the applicant on 11 Dec. 1956.

BACKGROUND OF THE INVENTION

The invention relates generally to particle dispensing devices, and more specifically to plural chamber particle dispensing devices. More particularly the invention relates to dispensers for condiments and granular particles.

Before the grant of applicant's prior patent in 1956, condiment dispensers generally consisted of two separate shakers, each of which the user inverted to dispense condiment, or, if the condiment was dispensed from the bottom of the container without being inverted, the dispensers included moving parts such as valves, push buttons and the like which were largely ineffective because of clogging by the whirling condiment within the condiment chamber.

Applicant's prior patent combined into one container two chambers for two different condiments, operating automatically, without moving parts, eliminating the clogging problem, the need for two separate condiment containers and most of the necessary hand-reaching and wrist movement for their use and still retaining the desirable feature of dispensing the condiment from the bottom of the container.

Applicant's present invention which has been incorporated into an effectively working model, retains all the aforesaid advantages and makes improvements over the invention in his prior patent.

SUMMARY OF THE INVENTION

In accordance with this invention two separate chambers are combined within one container for the dispensing of two different particles such as condiments, or other granular substances from the top end or the bottom end of the container automatically, without moving parts or the intervention of any hand, wrist, or other body exertion except by simply inverting the container when the variety of particle condiment desired by the user is in the upper chamber.

Further in accordance with this invention, a particle dispenser comprises a container with a particle chamber with closure means mounted on an end of the container provided with an inwardly extending, centrally disposed outlet passage. Particle-blocking means is secured in position within the particle chamber. The particle-blocking means has a proximal surface facing and confronting and being situated proximate to and in direct alignment with the inwardly extending, centrally disposed outlet passage. There is a gap between the proximal surface of the particle-blocking means and the inwardly extending, centrally disposed outlet passage proximate thereto.

Preferably, the particle-blocking means within the chamber comprises a ball shaped component, a half-rounded component steepled on the opposite side, or a half-rounded component obtunded on the opposite side whose diameter approximates or exceeds that of the inwardly extending, centrally disposed outlet passage proximate thereto.

Preferably, the particle-blocking means is composed of a material repellent to particles and has a smooth glassy-surface; the container is transparent; the particle-blocking means is composed of a material repellent to particles and has a smooth glassy-surface; and/or the container is transparent.

BRIEF DESCRIPTION OF THE DRAWINGS

The features of the invention, set forth in the appended claims, will be best understood by reference to the following detailed description of the illustrative embodiments when read in conjunction with the accompanying drawings. In the drawings, some like elements are numbered alike and similar parts located on the top or bottom of the embodiments of the invention bear the same designation numbers. Numbers for parts on the tops of the embodiments are primed with respect to the numbers on the corresponding parts on the bottoms of the embodiments.

DETAILED DESCRIPTION OF PREFERRED EMBODIMENTS OF THE INVENTION

The invention is applicable for the dispensing of particles such as salt, pepper, other types of condiments or other types of particles or granular substances to be dispensed from a container.

Figure 1:
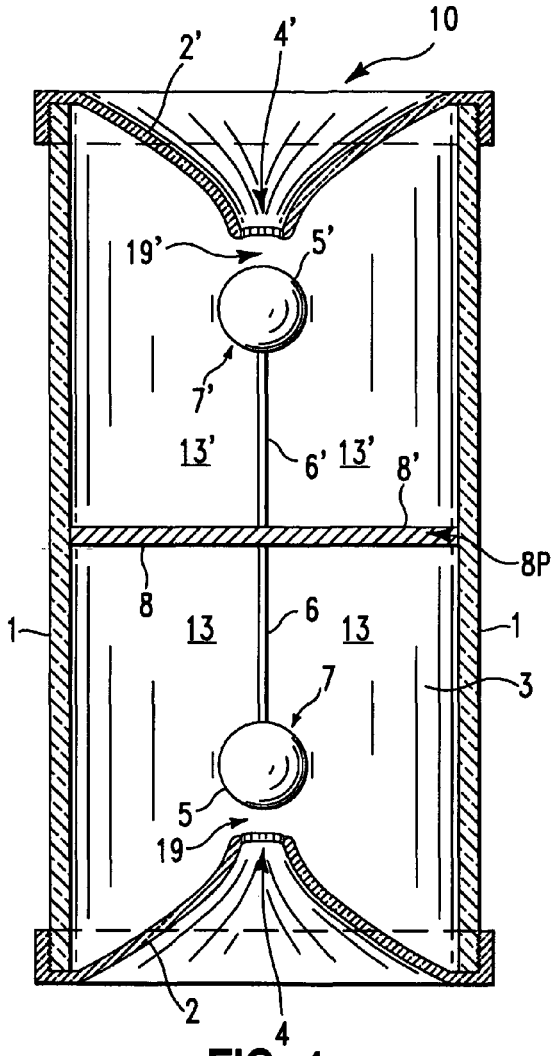
FIG. 1 is an elevational, sectional view of a shaker in accordance with this invention.

FIG. 1 is a sectional, elevational view of a shaker 10 in accordance with this invention. The shaker 10 consists of a hollow cylindrical container 1 with each of its ends covered with a respective one of the lower and upper solid closures 2 and 2' mounted on the respective lower and upper ends of the container 1. The container 1 is divided internally into two cylindrical chambers including a lower chamber 13 and an upper chamber 13' which are separated by a partition 8P. The partition 8P is secured/bonded to the inner walls of the container 1. The partition 8P has two surfaces including a lower surface 8 and an upper surface 8'.

The solid closures 2 and 2' have inwardly extending, and inwardly narrowing funnel-shapes with centrally disposed outlet passages 4 and 4' (also referred to herein as apertures 4 and 4) within the container 1. The closures 2 and 2' are mounted on the opposite ends respectively of the lower chamber 13 and the upper chamber 13' of the container 1. The widest opening of each closure 2 and 2' is at each respective end of the container 1 with the narrower end of each closure 2 and 2' leading into the interior of each respective chamber 13 and 13', ending with a corresponding one of two outlet apertures 4 and 4' which comprise outlets in the form of interior orifices for dispensing particles of materials such as condiments from the shaker 10. Preferably, as shown, the cylindrical container 1 and the closures 2 and 2' are transparent to permit viewing of the contents therein.

In FIG. 1, particle-blocking components in the form of round balls 5 and 5' are provided to partially block some of the particles in the chamber 13 and 13' from reaching the apertures 4 and 4'. The particle-blocking round balls 5 and 5' are retained in fixed, stationary positions relative to the apertures 4 and 4'. The round balls 5 are centrally located in each of the chambers 13 and 13' proximate to the outlet apertures 4 or 4' and spaced therefrom by a gap thereby permitting some particles to pass thereby through one or the other of the outlet apertures 4 or 4' depending upon whether or not the shaker 10 is inverted.

In the lower chamber 13, the particle-blocking round ball 5 partially blocks the particles to be dispensed from the lower chamber 13 reaching from the aperture 4 when the shaker 10 is shaken, while some of the particles are dispensed through the aperture 4. Similarly, when the shaker 10 is inverted the particle-blocking round ball 5' in the upper chamber 13' partially blocks the particles to be dispensed from the upper chamber 13' from reaching the aperture 4', while some particles are dispensed through the aperture 4'. The round balls 5 and 5' are shown to have respective rounded underbodies 7 and 7' which are affixed to the proximal ends of the cylindrical support rods 6 and 6' respectively.

In FIG. 1, the distal end of each of the cylindrical support rods 6 and 6' is rigidly affixed respectively to the lower and upper surfaces 8 and 8' of the partition 8P in the respective one of the lower chamber 13 and the upper chamber 13'. Thus in each chamber 13 and 13' one of the balls 5 and 5' is rigidly secured in place, in a fixed, stationary position relative to the orifices of the respective outlet passage 4 and 4, proximate to, and in alignment with the respective one of the interior rims of the orifices of the outlet apertures 4 or 4' by its support rod 6 or 6'. Each of the balls 5 and 5' is spaced from the proximate interior rim of the proximate aperture 4 and 4' by a respective gap 19 and 19'. The gaps 19 and 19' provide spaces permitting some particles to escape through the rim of the proximate aperture 4 or 4' from the respective chamber 13 or 13' while other particles are diverted and fall back under the force of gravity onto the inner surface of the closure 2 or 2'.

Figure 2:
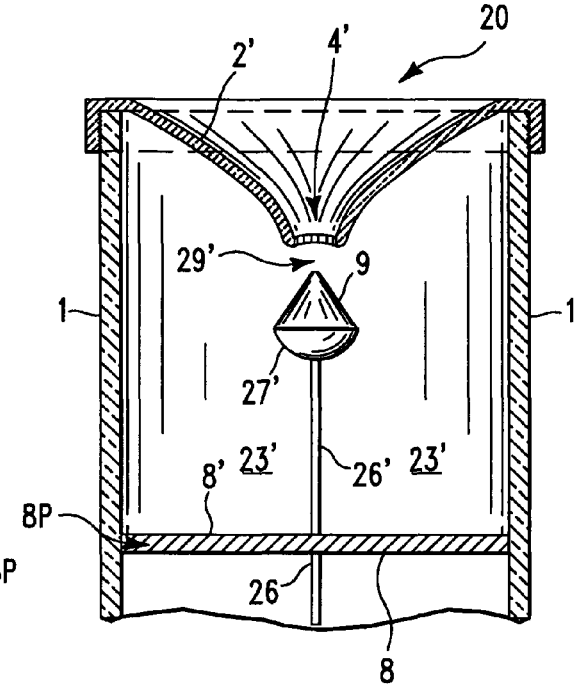
FIG. 2 is a fragmentary, sectional, elevational view of the upper portion of an alternative shaker in accordance with this invention which is a modification of FIG. 1.

FIG. 2 is a fragmentary, sectional, elevational view of a modified shaker 20 very similar to the shaker in FIG. 1 with only an upper chamber 23' fully depicted for convenience of illustration. The difference shown by FIG. 2, is that an alternative, particle-blocking component 9 which has a half-rounded bottom end and half-steepled proximate end and which is retained in a fixed, stationary position relative to the aperture, i.e. orifice, of the outlet passage 4' to partially block the particles in the upper chamber 23' from reaching or passing through the aperture 4'.

Figure 3:
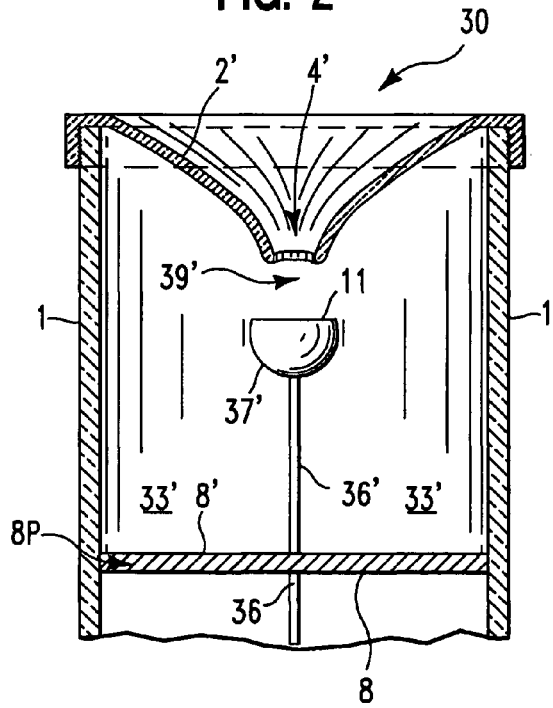
FIG. 3 is also a fragmentary, sectional, elevational view of the upper portion of another alternative shaker in accordance with this invention which is a modification of FIG. 1.

The component 9 is secured rigidly in place by a cylindrical support rod 26' with the apex of the half-steepled component 9 proximate to and in alignment with the interior aperture 4' in the upper chamber 23' spaced by a gap 29' from aperture 4' providing a space permitting some of the condiments or particles of a granular substance to escape from the upper chamber 23'. Component 9 is shown with a rounded underbody 27' affixed to a rigid cylindrical support rod 26' that is affixed to the upper surface 8' of the partition 8P in chamber 23'. A lower rod 26 is secured to the bottom surface 8 of the partition 8P and a similar half-rounded and half-steepled particle-blocking component which is not shown, but as will be well understood by those skilled in the art, would be provided there for the same purpose and analogous to the lower end of FIG. 1, as will be well understood by those skilled in the art As a further alternative, FIG. 3 is a fragmentary sectional elevational view of a shaker 30, also similar to the shaker 10 in FIG. 1. Only an upper chamber 33' is fully depicted for convenience of illustration. In FIG. 3, particles in the upper chamber 33' are to be partially blocked from reaching or passing through the aperture 4' by an alternative, half-rounded and half-obtunded particle-blocking component 11, that may be flattened on the proximate end or flat as shown in FIG. 3. Component 11 is rigidly secured in place by an upper support 36' proximate to and in alignment with the interior aperture 4' in upper chamber 33'.

The upper chamber 33' contains an alternative, particle-blocking component 11 which has a half-rounded bottom end and half-obtunded proximate end. The component 11 is rigidly secured in place in a fixed, stationary position relative to the orifice of the outlet passage 4' by a cylindrical support rod 36' with the flat upper surface on the one end of the half-obtunded component 11 proximate to and in alignment with the interior rim of the interior aperture 4' in the upper chamber 33' but spaced from the aperture 4' by a gap 39' providing a space permitting condiments or particles of a granular substance to escape from the upper chamber 33'. The component 11 is shown to have a rounded underbody 37' on the opposite end thereof, which is affixed to the rigid cylindrical support rod 36' that is affixed to the upper surface 8' of the partition 8P. A lower rod 26 is secured to the bottom surface 8 of the partition 8P and a similar half-rounded and half-obtunded particle-blocking component which is not shown would be provided there for the same purpose and analogous to the lower end of FIG. 1, as will be well understood by those skilled in the art.

Figure 4:
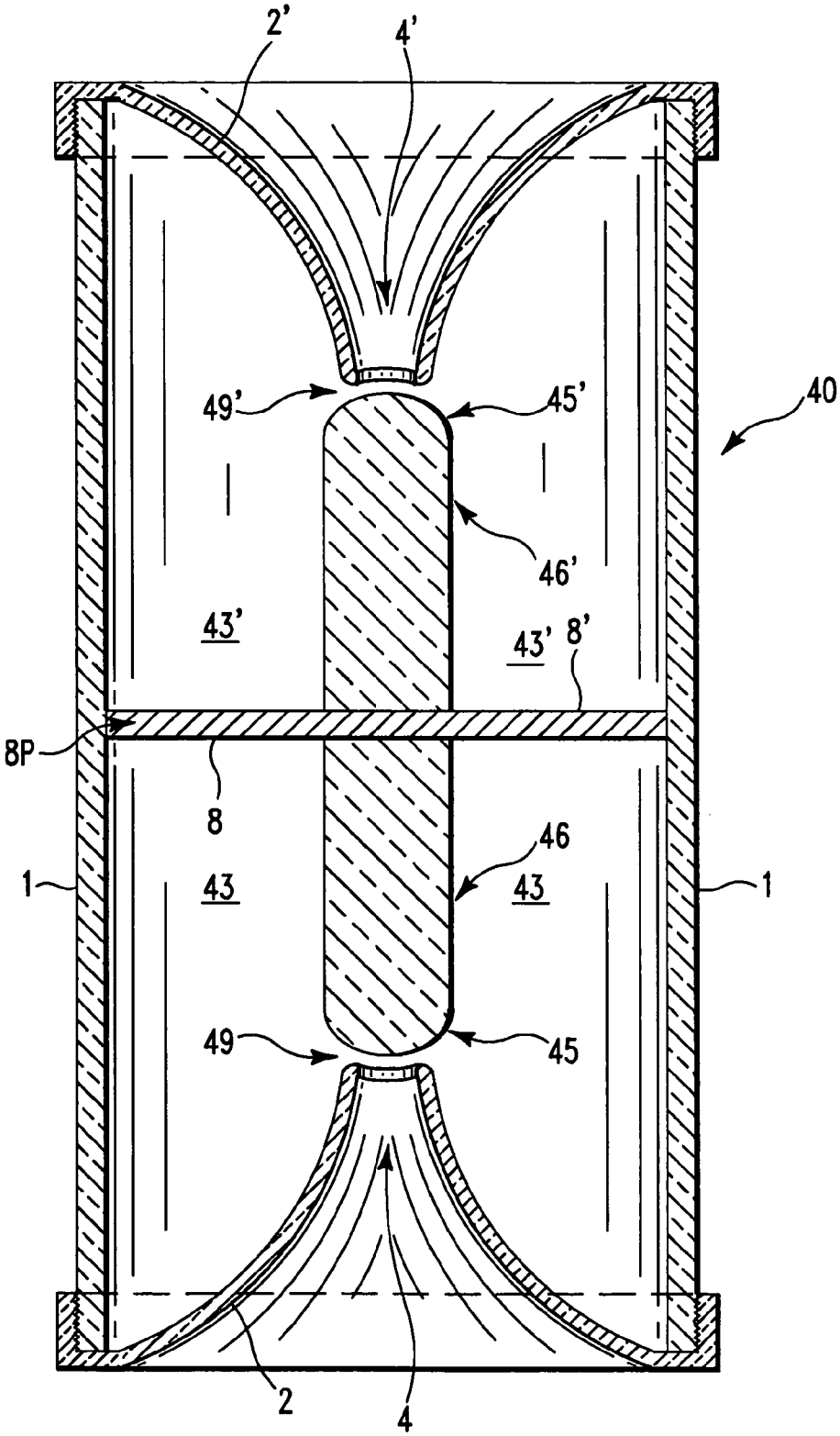
FIG. 4 is a sectional, elevational view of a shaker which is a modification of FIG. 1.

FIG. 4 is a sectional, elevational view of a modified shaker 40 in accordance with this invention. It consists of a cylindrical container 1, divided internally into an upper chamber 43' and a lower chamber 43 separated by a partition 8P. The partition 8P, which is secured to the inner walls of the cylindrical container 1, has a lower surface 8 and an upper surface 8'. As in FIG. 1, each end of the container 1 is covered by a closure 2 or 2' shown to be threadedly secured to the container 1.

Both of the closures 2 and 2' are funnel-shaped with inwardly extending, centrally disposed outlet passages 4 and 4' and they are shown to be threadedly secured to the container. The widest opening of each closure 2 and 2' is at each end of the container with the narrower end of each closure 2 and 2' leading into the interior of each chamber 43 and 43', ending with a corresponding one of the apertures 4 and 4' which comprise outlets in the form of interior orifices for distribution of condiments from the shaker 40. In each chamber 43 and 43', a particle-blocking component a rigid cylindrical rod 46 with a proximal rounded end 45 and a rigid cylindrical rod 46' with a proximal rounded end 45 is provided.

In FIG. 4, the distal end of each of the cylindrical support rods 46 and 46' is rigidly affixed respectively to the lower and upper surfaces 8 and 8' of the partition 8P in the respective one of the chambers 43 and 43'. Thus in chambers 43 and 43' each rounded end 45 and 45' is rigidly secured in place in a fixed, stationary position relative to the respective aperture, i.e. orifice, of the outlet passage 4 or 4', proximate to and in alignment with the respective one of the interior rims of an aperture, i.e. orifice of the outlet passage 4 or 4' by its support rod 46 or 46'. Each rounded end 45 and 45' is spaced from the proximate interior rim of the proximate aperture 4 and 4' by a respective gap 49 and 49'. The gaps 49 and 49' provide spaces permitting condiments or particles of a granular substance to escape through the proximate aperture 4 or 4' from the respective chamber 43 or 43'.

Figure 5:
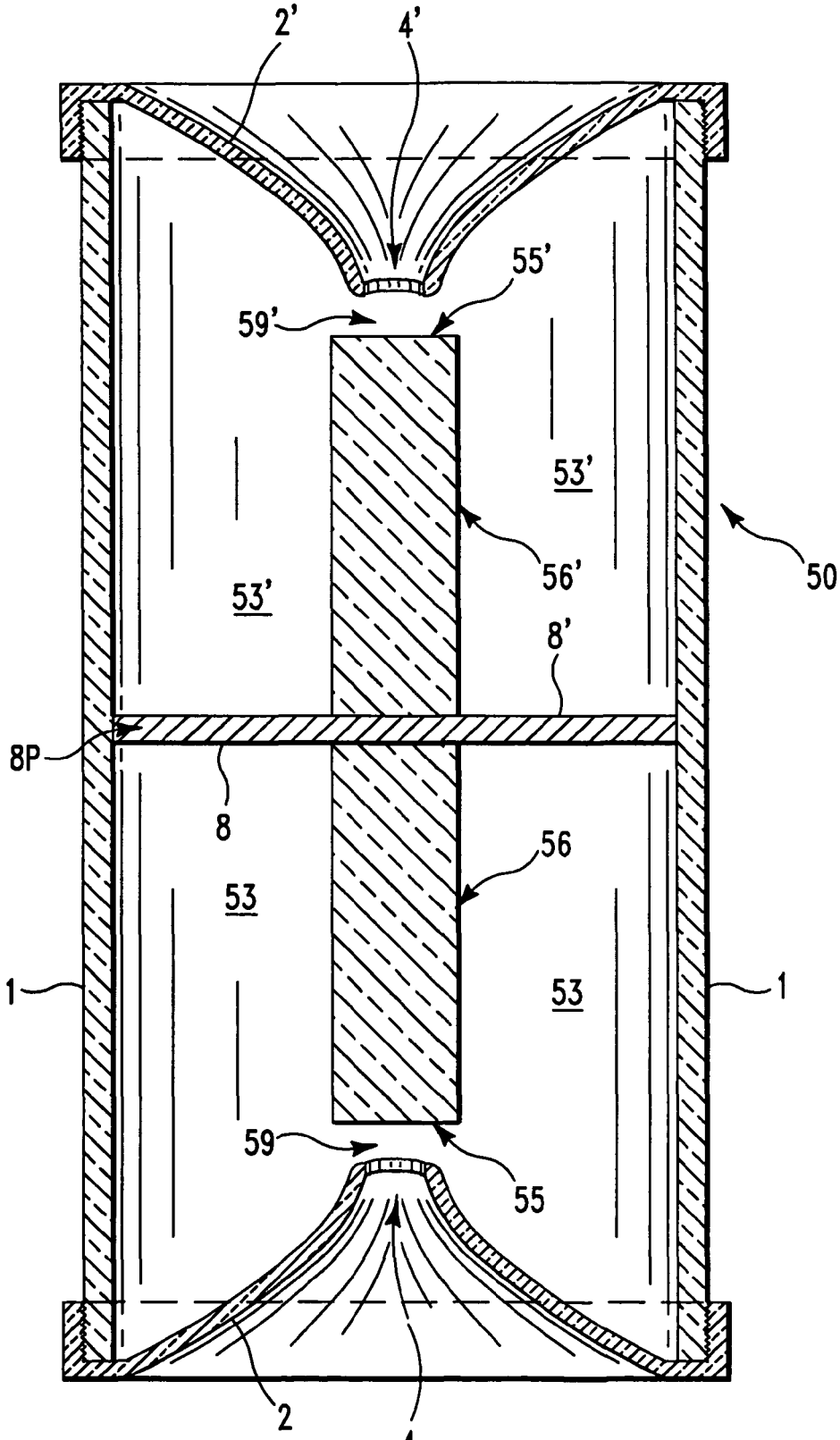
FIG. 5 is a sectional, elevational view of a shaker which is still another modification of FIG. 1.

FIG. 5 is a sectional, elevational view of a modified shaker 50 in accordance with this invention. It consists of a cylindrical container 1, open-ended on each end, divided internally into two chambers including an upper chamber 53' and a lower chamber 53 by a partition 8P secured to the inner walls of the cylindrical container 1. The partition 8P has a lower surface 8 and an upper surface 8'. Each end of the container 1 is closed by a closure 2 or 2' shown to be threadedly secured to the container 1.

Both of the closures 2 or 2' are funnel-shaped and they are shown to be threadedly secured to the container 1. The widest opening of each closure 2 and 2' is at each end of the container. The narrower end of each closure 2 and 2' leads into the interior of each chamber 53 and 53', ending with a corresponding one of the apertures 4 and 4' which comprise outlets in the form of interior orifices for distribution of condiments from the shaker 50. As shown in FIG. 4, in the lower chamber 53, a particle-blocking component comprises a rigid cylindrical rod 56 with a proximal flattened or obtunded end 55; and in the upper chamber 53' a particle-blocking component comprises a rigid cylindrical rod 56' with a proximal flattened or obtunded end 55' respectively.

In FIG. 5 the distal end of each of the cylindrical support rods 56 and 56' is rigidly affixed respectively to the lower and upper surfaces 8 and 8' of the partition 8P in the respective one of the chambers 53 and 53'. Thus in each chamber 53 and 53' each of the ends 55 and 55' is rigidly secured in place in a fixed, stationary position relative to the respective outlet passage 4 or 4', proximate to and in alignment with the respective one of the interior rims of an apertures 4 or 4' by its support rod 56 or 56'. Each of the ends 55 and 55' is spaced from the proximate interior rim of the proximate aperture 4 and 4' by a respective gap 59 and 59'. The gaps 59 and 59' provide spaces permitting condiments or particles of a granular substance to escape through the proximate aperture 4 or 4' from the respective chamber 53 or 53'.

Operation of the Invention

Referring to FIG. 1, for convenience of explanation, it will be assumed that the shaker 10 contains salt and pepper as condiments, but it will be well understood by those skilled in the art that the particles in the shaker may be particles of any condiment or any other granular substance or material. The shaker 10 operates similarly to the embodiments of FIGS. 2-5, so this explanation applies to those embodiments as well.

In operation of the shaker 10, if the condiment desired by the user is the salt which is assumed to be in the lower chamber 13 of the container 1, the user must only shake the container 1, vertically or obliquely to dispense salt crystals. The upward movement of the shaker 10 will precipitate some of the salt from its resting place upon the closure 2 within the salt chamber 13 to the interior open end 4 of closure 2 to be dispensed through the interior open end 4 of closure 2 upon the food to be seasoned by force of gravity and the user's return or counter-shake of the container 10.

Many of the salt crystals elevated to a higher position within the salt chamber 13 by the user's vigorous shaking of the container 10 will precipitate down into a resting position on closure 2 within the salt chamber 13 and will not pass through the interior open end 4 of closure 2, because those salt crystals are diverted, as they descend, by means of the blocking or shielding action of the ball-shaped component 5 or the rounded underbody 7.

Similarly if the condiment desired by the user is the pepper, the user inverts the shaker 10, so that cover 2' is on the bottom, to dispense the pepper which is shown in the upper chamber 13' of the container 1 in FIG. 1. The user must again only shake the inverted container 1, vertically or obliquely. The upward movement of the shaker 10 will precipitate some of the pepper particles from their resting places upon the closure 2' within the pepper chamber 13' to the interior open end 4 of closure 2' to be dispensed through the interior open end 4' of closure 2' upon the food to be seasoned by force of gravity and the user's return or counter-shake of the container 10.

As with the salt, when the shaker 10 is inverted to dispense pepper, many of the pepper particles lifted to a higher position within the pepper chamber 13' by the user's vigorous shaking of the inverted container 10 will precipitate into a resting position on closure 2' within the pepper chamber 13' and not into the interior open end 4' of closure 2', being diverted, as they descends, by means of the blocking or shielding action of the ball-shaped component 5' or the rounded underbody 7' in FIG. 1.

The same applies to the rounded underbody 27' of the steepled component 9 in FIG. 2 or the rounded underbody 37' of the obtunded component 11 in FIG. 3, the three latter of which have a diameter approximately the same as or greater than the interior open ends 4 and 4' of closures 2 and 2' and situated within the chambers 13 and 13' of FIG. 1 proximate to and in alignment with the interior open ends 4 and 4' of closures 2 and 2'.

During descent of the condiment or particles in the chambers after shaking, the rounded "lower" surfaces 7 and 7', 27' and 37' of all three types of components, 5, 10 and 11, will cause the condiment or particles or granular substance to spread out and slide to the sides of the chambers 3 and 3', 23', and 33' away from the interior open ends 4 and 4' and not into the open ends 4 and 4' of the closures 2 and 2' and be improperly emitted.

During the user's aforesaid salt-shaking action, the pepper or other particles of a granular substance in the pepper chamber 3', then situated above, precipitate upwardly but will not be emitted improperly through the open end 4' of pepper chamber 3', 23', or 33' because of the same shielding or blocking action of the pepper support 6' and its rounded 5' proximal surface as well as the proximal surface of steepled component 9 in FIG. 2 and the proximal surface of obtunded component 11 in FIG. 3, the latter three of which has a diameter approximately the same as or greater than the interior open end 4' of the pepper closure 2' and situated within the pepper chamber proximate to and in alignment with the interior open end 4' of closure 2'.

If particles of an alternative seasoning desired by the user are in the upper or pepper chamber, the user can invert the container, hold the same over the food to be seasoned or the surface to be treated and the shaking method of operation described above with respect to the salt chamber can be repeated, whereby the same shielding and blocking action, the same spreading out and sliding of the condiment to the side of the container chambers by the rounded "lower" surfaces of all three types of post ends, the user's counter or return stroke, the same scooping action of the funnel-shaped container closures and the force of gravity will produce the same result for the alternative seasoning as for the salt or pepper.

Should a particle, e.g. salt or pepper, inadvertently be emitted from the top of the shaker 10 when the user is shaking for the other variety of particle on the bottom of the shaker 10, the wide, funnel-shaped exterior ends of closures 2 and 2' of the container 1 scoop up an errant particle e.g. a condiment particle, which returns under the force of gravity to the proper chamber 13 or 13' on the user's return or counter-shake of the container 1. Preferably the cylindrical container 1 is transparent as shown in the drawings permitting observation of the particle levels in the chambers.

For best results it is preferable that shaker components should be as follows:

a) the rounded, steepled and obtunded particle-blocking components 5, 5', 9, 11, 45, 45', 55, 55' should be hard, smooth and glassy-surfaced and made of a material repellent particle or condiment residue and prevent particles or condiment from clinging to the components and supports 6 and 6', 26 and 26', and 36 and 36', 46 and 46', and 56 and 56', and b) the condiment chambers should be filled no higher than any part of the aforesaid components, and c) filling of the condiment chambers may be done through the exterior funnel closures without removal of the closures which may or may not be removable.

The improvements herein are different from and exceed prior art in the field of combination particle or condiment dispensers, including applicant's prior patent by the substitution of the simple supports 6 and 6' and the component varieties 5, 9, and 11 for the cap or baffle 13 and its intricate, clogging supports on tubes 11 and 11' (not shown in applicant's prior patent).

The improved structures of the embodiments of the present invention operate amid the snowstorm of salt and pepper flying helter skelter within the container chambers to produce a highly efficient result. These structures prevent errant, unwanted condiment discharges on the food or the user's table from the condiment chamber not in use.

Manufacturing and assembly of the dispenser is simplified through the elimination of three parts plus the bend or twist in the tubes 11 and 11' of applicant's prior patent while retaining the desirable feature of condiment emission from the ends of the container.

In summary, the present invention combines within one container two separate chambers for the dispensing of two different particles such as condiments, or other granular substances from one or both ends of a container automatically, without moving parts or the intervention of any hand, wrist, or other body exertion except for the simple turning over of the container when the variety of particle condiment desired by the user is in the upper chamber.

The present invention shares the aforesaid advantages with applicant's prior patent grant, but greatly increases its operating efficiency by means of the new improvements and accomplishes a far better operating result as well as reducing necessary parts to a maximum of three (the container 1 and the two closures 2 and 2') instead of the six parts shown in the drawings in applicant's U.S. Pat. Ser. No. 2,773,628.

The foregoing description discloses only exemplary embodiments of the invention. Modifications of the above disclosed apparatus and methods which fall within the scope of the invention will be readily apparent to those of ordinary skill in the art. While this invention is described in terms of the above specific exemplary embodiment(s), those skilled in the art will recognize that the invention can be practiced with modifications within the spirit and scope of the appended claims, i.e. changes can be made in form and detail, without departing from the spirit and scope of the invention. Accordingly, while the present invention is disclosed in connection with exemplary embodiments thereof, it should be understood that changes can be made to provide other embodiments which may fall within the spirit and scope of the invention and all such changes come within the purview of the present invention and the invention encompasses the subject matter defined by the following claims.

What is claimed is:

1. A condiment dispenser comprising; a container having opposite ends and a partition which creates two separate condiment chambers;

a closure mounted on each of the opposite ends of said container, each closure having an inwardly extending, inwardly narrowing, funnel-shaped centrally disposed outlet passage terminating in a centrally disposed interior orifice within each of the two separate condiment chambers;

each condiment chamber including a condiment-blocking component, each condiment-blocking component being rigidly secured within each of the condiment chambers by a support which is directly secured at one end to the partition and at an opposite end to one of the condiment-blocking components;

each condiment-blocking component having blocking surfaces proximate to and in alignment with each centrally disposed interior orifice; the blocking surfaces include a surface area which is at least equal to an area encompassed by the centrally disposed interior orifices; the blocking surfaces being secured in a fixed, stationary position within each of the two separate condiment chambers and spaced from said centrally disposed interior orifices by a gap.

2. The condiment dispenser of claim 1 in which the condiment-blocking component is ball-shaped.

3. The condiment dispenser of claim 1 in which the condiment-blocking component includes a conical lower surface facing the centrally disposed interior orifice and a half rounded upper surface opposite the conical lower surface.

4. The condiment dispenser of claim 1 in which the condiment-blocking component includes a planer lower surface facing the centrally disposed interior orifice and a half rounded upper surface opposite the planer lower surface.

* * * * *